United States Patent [19]

Falletta et al.

[11] Patent Number: 5,012,964

[45] Date of Patent: May 7, 1991

[54] AMPHIBIOUS BACKPACK

[76] Inventors: Angelo Falletta, Via Tartaglia, 24; Roberto Barbierato, Via Tallone, 12, both of Milan, Italy

[21] Appl. No.: 301,174

[22] Filed: Jan. 24, 1989

[30] Foreign Application Priority Data

Jan. 25, 1988 [IT] Italy ..... 19188 A/88

[51] Int. Cl.[5] ..... A45F 4/02

[52] U.S. Cl. ..... 224/153; 224/209; 224/162; 383/103

[58] Field of Search ..... 224/151, 153, 209, 213, 224/214, 215, 216, 264, 902, 162; 116/209, 202; 206/803; 441/89, 102, 111, 80, 90, 88; 405/186; 383/103, 67; 128/201.27, 201.29, 205.22

[56] References Cited

U.S. PATENT DOCUMENTS

| | | | |
|---|---|---|---|
| 1,251,404 | 12/1917 | Mills | 383/103 |
| 1,816,262 | 7/1931 | Ritter | 224/259 |
| 2,118,708 | 5/1938 | Johnson | 441/111 |
| 3,034,596 | 5/1962 | Twaits, Jr. | 405/186 |
| 3,228,080 | 1/1966 | Trauger | 405/186 |
| 3,621,501 | 11/1971 | Jordan | 441/89 |
| 3,679,108 | 7/1972 | Ingram | 224/209 |
| 4,156,446 | 5/1979 | Nathan | 383/103 |
| 4,213,549 | 7/1980 | Hibbard | 224/209 |
| 4,790,463 | 12/1988 | Hansen | 224/253 |

FOREIGN PATENT DOCUMENTS

| | | | |
|---|---|---|---|
| 2278290 | 2/1976 | France | 224/209 |
| 2535589 | 5/1984 | France | 224/153 |
| 2590458 | 5/1987 | France | 224/153 |
| 1009398 | 11/1965 | United Kingdom | 224/209 |

*Primary Examiner*—Linda J. Sholl
*Attorney, Agent, or Firm*—Ladas & Parry

[57] ABSTRACT

A backpack for overland and underwater use having a central compartment for a first tightly-sealable sack adapted to contain the user's personal belongings, a rear compartment having a second tightly-sealable sack containing a sheet of foam material usable as a mattress, and a front compartment containing an inflatable bladder adapted to provide the backpack with good floating characteristics such that the backpack can be used as an element for logistic support and/or as a safety element for a skin-diver. The bottom region of the various compartments is provided with drainage for water. The backpack has straps which are capable of attachment in two ways, one for walking, the other for use in water. A line is provided for tethering the backpack to the user when underwater. The backpack is floatable when the bladder is inflated and a signal flag and flashlamp can be displayed.

12 Claims, 4 Drawing Sheets

3
29
II
34
18
17
18b
15
16
16
16
32
31
1
7
32
32
32
5
30
11
II
32
15
5C
2
26
50B
15
33
20
24
5B
50C
15
24
50A
4
24
5A
33
24
26
21
26
27
19
28
5D
22

AMPHIBIOUS BACKPACK

FIELD OF THE INVENTION

The present invention relates to an amphibious backpack, designed for use in trekking in general, and in particular for aquatic trekking, or also for use as a support means for anyone who performs submarine activity.

The term "trekking", is intended to refer to a sporting activity of traveling character, carried out in direct contact with the natural environment.

Aquatic trekking is a special type of trekking, in which the sportsman performs (as a completion of the main traveling activity) fully submerged or submarine activities, such as, e.g., underwater fishing. Underwater fishing, which is carried out under breath-hold diving conditions, most often enables the sportsman to provide the food necessary for his survival in a totally undeveloped environment, far from any human settlements.

The rewarding practicing of submarine trekking is however hindered at present by the lack of adequate equipment, and in particular, by a purposely designed backpack. In fact, any backpack available to date on the market cannot be transported in water during diving, because the personal belongings contained inside the presently available backpacks would become soaked with water, and would consequently excessively increase in weight, causing the same backpack to sink. According to the present practice, the sportsman removes his backpack and places it on the shore, and at the end of diving, he necessarily returns to the starting point, in order to recover the backpack and use the logistic support offered by it.

The need for returning, after the dive, to the same starting point (which, very often, has to be exclusively reached by swimming, owing to the configuration of the coast, which does not allow any other landing procedures) obliges the individual to expend a considerable amount of energy, besides having a marked sense of locality.

The wavy motion of water, the search for prey, or the combination of both factors, may in fact have driven the same skin-diver very far away from his starting point; the consequent impossibility to reach his backpack may become the cause of serious drawbacks for the individual.

SUMMARY OF THE INVENTION

An object of the present invention is to provide a backpack capable of obviating the above described drawbacks.

Such object is achieved by means of an amphibious backpack comprising a body closed at its top by a cover, and provided with slinging straps in order to fasten the backpack to the shoulders of the user, characterized in that it comprises a front compartment occupied by a bladder, a central compartment occupied by a first tightly-sealable sack, containing the transported personal belongings, a rear compartment occupied by a second tightly-sealable sack containing at least one sheet of a foamed material which can be used as a mattress, said front compartment, central compartment, and rear compartment being provided, in their bottom region, with openings for drainage of any admitted water.

The advantages deriving from the present invention essentially consist in that a backpack is made available, which:

can be carried in water too, without the personal belongings contained inside it being soaked, or being affected by moisture;

constitutes the logistic support for the skin-diver and a floating safety element in case the same skin-diver is in difficulty;

replaces the mandatory signalling buoy with which each skin-diver must be equipped according to as provided by the law.

The present invention is illustrated, for merely exemplifying, and non-limitative, purposes by the hereto attached drawing tables, wherein.

Figure 1:
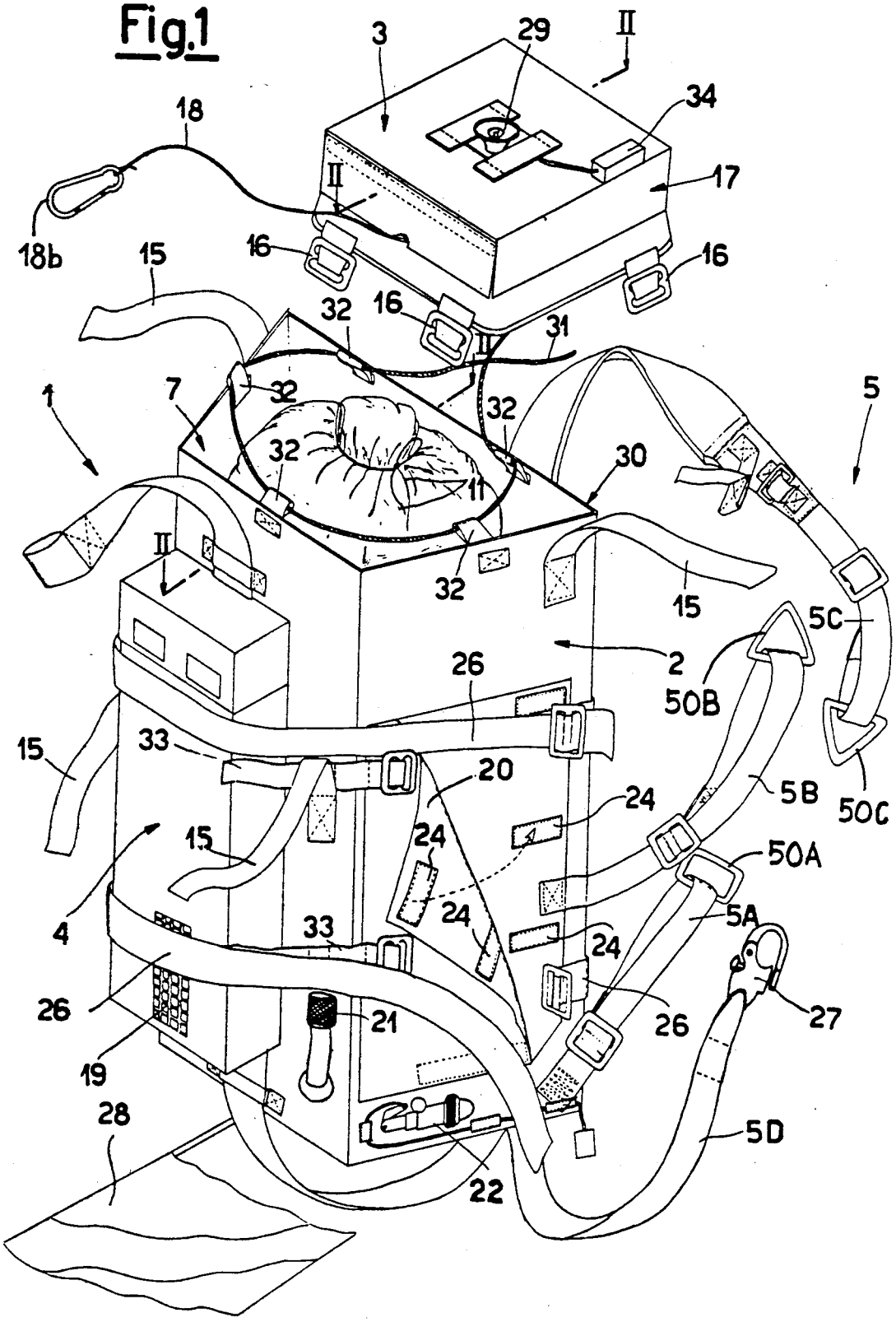
FIG. 1 shows a perspective view of the backpack.
Figure 2:
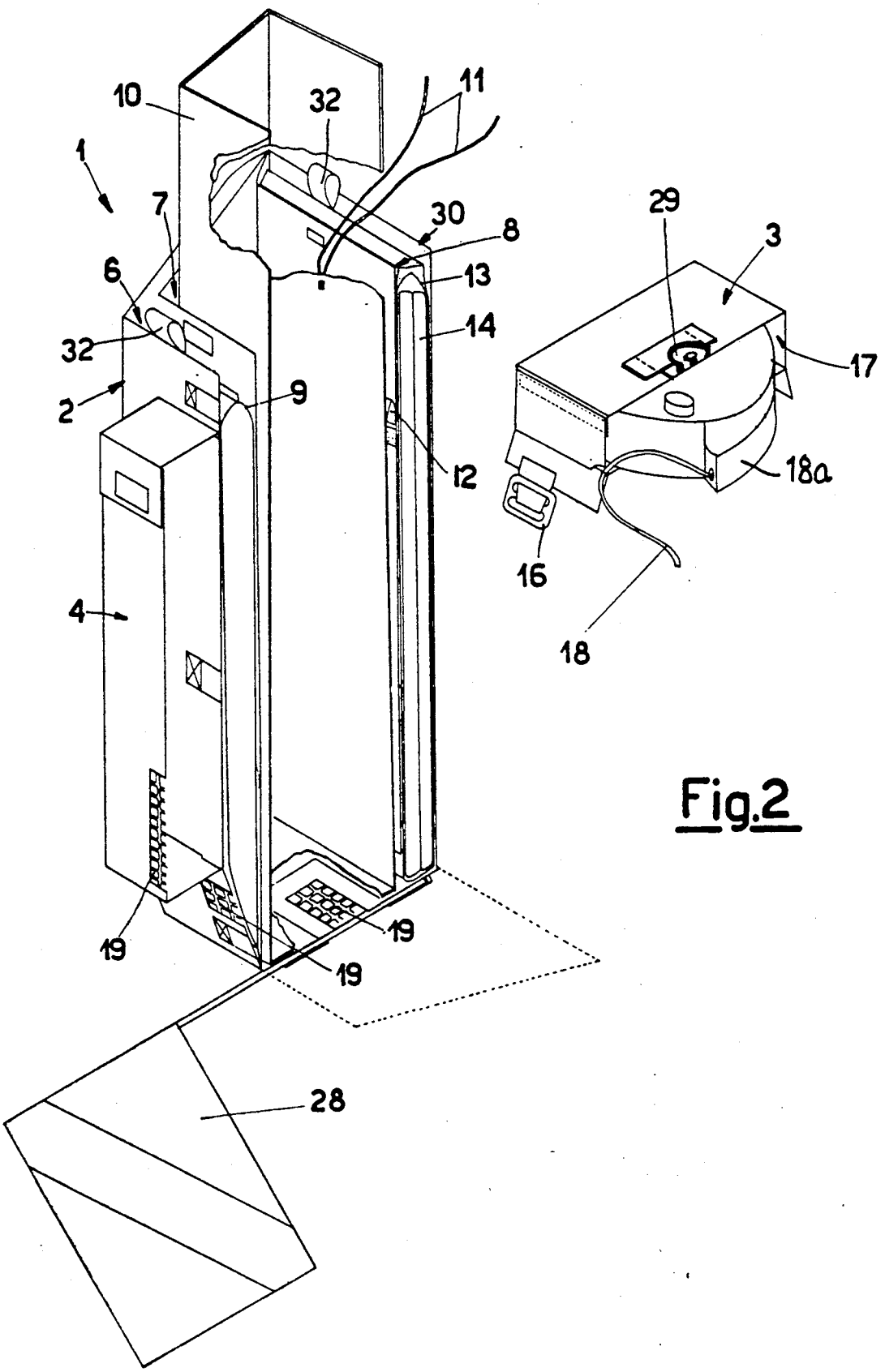
FIG. 2 shows a sectional view according to path II—II of FIG. 1.
Figure 3:
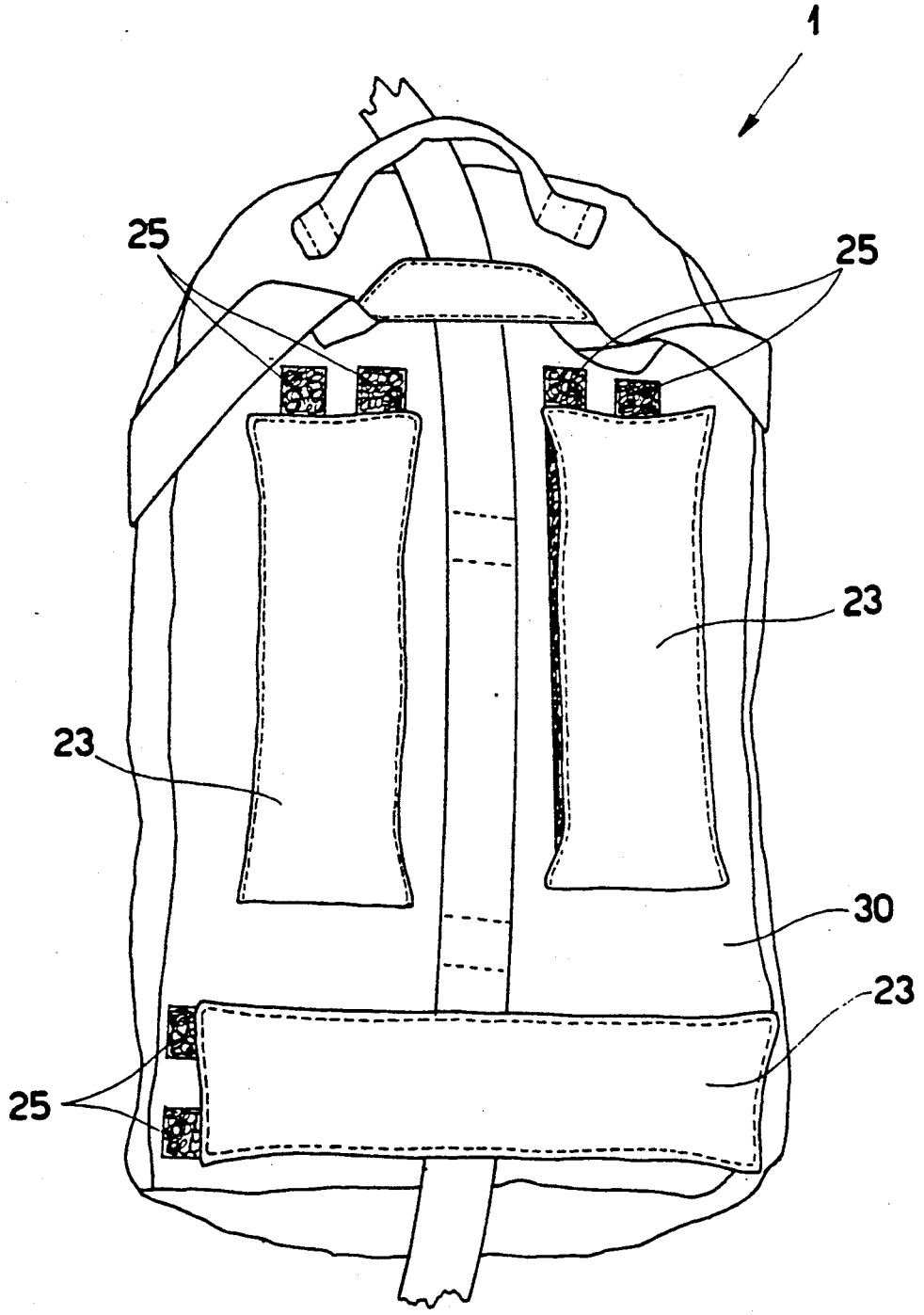
FIG. 3 shows a view of the back of the backpack.

Referring to the above cited figures, the backpack according to the present invention, generally indicated by the reference numeral 1, is formed by a soft material, non soaked by water, such as, e.g., nylon, and comprises a body 2, closed atop by a cover 3, a front pocket 4, strap means 5 for fastening it to the user's shoulders, and signalling means (28, 29), when the same backpack is used as a buoy.

The body 2 of the backpack is subdivided into at least three compartments: a front compartment 6, a central compartment 7, and a rear compartment 8 bounded by the back 30 of the backpack.

The front compartment 6 is occupied by a bladder 9 constituted by sectors, the size and shape of which, when said bladder is inflated, are such as to achieve with its overall dimensions being as small as possible, both the floating of the backpack, when fully loaded, and the floating of a person who may cling to the floating backpack. The bladder 9 is provided with a traditional conventional valve 21, and with a quick-inflating device 22 using cylinders containing carbon dioxide under pressure.

The central compartment 7 is intended to contain the useful load of the backpack 1, usually constituted by the personal belongings of the user, which are placed inside a first tightly-sealable sack 10, e.g., made from rubber-coated nylon, the mouth of which is closed by means of strings 11.

The mouth of the central compartment 7 is closed by one single string 31 cooperating with loops 32. The sack 10, can be removed from the central compartment 7 in order to promote drying which usually follows the use of the backpack in water. The sack 10 is connected to compartment 7, by means of a fabric bridge 12 interposed between an inner wall of the central compartment 7, and the outer surface of the sack 10.

The rear compartment 8 is occupied by a second tightly-sealable sack 13 (also made from the same material as the first sack 10), inside which at least one sheet of suitable thickness of a foamed material 14 (e.g., foam-rubber) is placed, to be used as a mattress when camping out. The tightly-sealed closure of the mouth of the second sack 13 is obtained by rolling up the edges of said sack mouth. The cover 3, which closes the body of the backpack 2, is connected to it by means of straps 15 and associated buckles 16, and is provided with an upper pocket 17 inside which is a housing 18A from which an automatic-winding line 18 extends; one end of line 18 is fastened to the backpack 1 in housing 18A , and the other end is fastened to the user by a connection means in the form of a buckle **18*b*** when the user is to carry out underwater activities, when used underwater.

The front pocket 4 is so positioned, and has such a structure, that it can be easily accessed, to store frequently-used articles.

The front pocket 4, the front compartment 6, and the central compartment 7 are provided, in their bottom regions, with openings 19 in order to drain any water which may possibly have entered the backpack. The openings 19 are closed by nets formed, e.g., of nylon coated with polyvinyl chloride (P.V.C.). The rear compartment 8 is not provided with an opening 19, because it is in communication, at its bottom, with the central compartment 7, and therefore any which has entered can drain, the drain through opening 19 of said central compartment 7.

The body 2 of the backpack is provided with frontal straps 33, with side flaps 20 and side load-compressing straps 26, and with rear stuffed cushions 23 capable of reducing the pressure generated by the weight of the backpack 1 on the back of the user. The straps 33 can be used for fastening a submersible flashlight and a spear gun, not illustrated.

The flaps 20, which can be closed by fasteners 24, can house, during walking, swim fins (not shown in the figures). The fasteners 24 for closing the flaps 20 can be Velcro fasteners which are made of releasable barbs and loops on the fastened parts.

The load-compressing straps 26 are constituted by straps which are capable of reducing the useful volume of the backpack 1 when the latter is not used under full-load conditions. In such a way, carrying the backpack is made easier, with better fastening of the personal belongings therein.

The cushions 23 are fastened to the rear of the backpack 1 by means of stripes of Velcro fasteners 25. Such cushions, which are particularly useful during walking to better distribute the load on the user's back, are removed when the backpack is used in water, and are housed inside one of the tightly sealable sacks 10, 13.

The strap means 5 comprise sets of straps 5A, 5B, 5C, 5D, which can be mutually associated in order to form two slinging types, in each case of quick-release type, to be selected according to the way the backpack is used. Straps 5A carry rectangular buckles 50A at their ends, straps 5B carry triangular buckles 50B at their ends and straps 5C carry triangular buckles 50C at their ends. Attached to straps 5C are connecting strips 51. Each strap is adjustable in length. 51. Each strap is adjustable in length.

Figure 4:
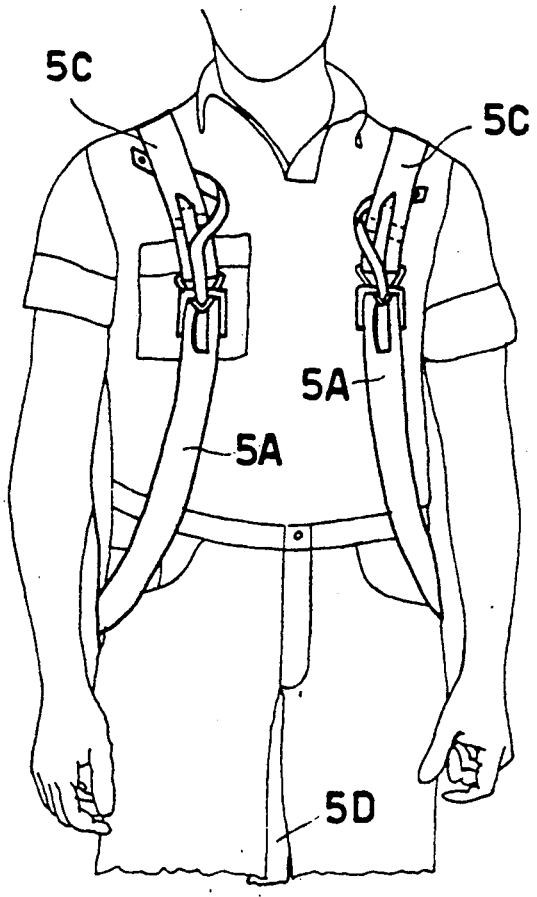
FIG. 4 shows a schematic view of the backpack borne by the user in march arrangement.

By uniting the straps 5A and the straps 5C to each other by connecting strips 51 as shown in FIG. 4, a slinging configuration is obtained, which is constituted by a pair of parallel shoulder straps, to be used when traveling on the ground. The quick disengagement of the straps 5A from the straps 5C, with the consequent quick opening of the shoulder straps, is obtained by means of a system already known and used on backpacks of traditional type.

Figure 5:
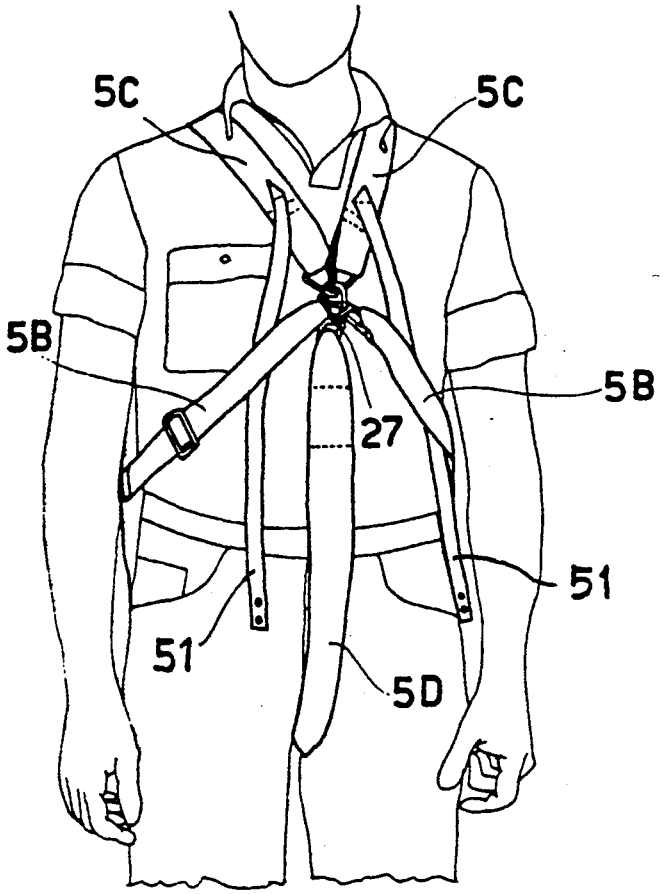
FIG. 5 shows a schematic view of the backpack borne by the user in diving arrangement.

By uniting the buckles 50B on straps 5B buckles 50C and 50D of respective straps 5C and 5D, a convergent-strap configuration is obtained, with the straps converging at the center of the user's chest. The buckles on straps 5B, 5C and 5D are connected by one single quick-opening clamp 27 installed at the end of the strap 5D (see FIG. 5).

Such a configuration is particularly recommended when the backpack 1 is used in water by a skin-diver. In such case, the skin-diver, after swimming to the diving point opens the clamp 27, instantaneously freeing himself from the backpack 1. The backpack 1 remains at the water surface, thanks to its floating characteristics, so as to act as a buoy and as a support point for the skin-diver, as the skin-diver remains constantly tethered to the floating backpack thanks to the automaticwinding line 18.

Furthermore, by suitable coloration of the backpack and by virtue of its size the backpack can have extremely good characteristics of visibility at the water surface. The backpack 1 further satisfies its signalling task, thanks to the presence of a flag 28 fastened to its bottom and of a lamp 29 installed on the backpack cover 3, and energized by a battery 34 of marine type.

What is claimed is:

1. An amphibious backpack comprising a body having an open top, a cover detachably mounted on said open top of the body, strap means on said body for fastening the backpack to the user, said body comprising front, central and rear compartments successively juxtaposed on one another, the rear compartment being closest to the back of the user, an inflatable bladder in said front compartment, means for inflating said bladder, a sealable first sack in said central compartment for personal belongings of the user, a sealable second sack containing at least one sheet of foam material which can be used as a mattress in said rear compartment, said front compartment, central compartment, and rear compartment having bottom regions respectively provided with openings for drainage of water from said compartments, said strap means including straps and a releasable clamp means for detachably connecting said straps, said strap means having a first configuration in which the backpack can be worn by the user when walking on the ground and a second configuration for use in water, said clamp means being constructed to permit concurrent release of said straps in said second configuration to enable said body to be separated from the user, when in water and a line connected to the backpack including means for connection to the user and of a length such that with the backpack released from the user and floatable in water with said bladder inflated, the user is fully submerged and tethered to the backpack and can carry out underwater activities.

2. A backpack as claimed in claim 1 wherein in said first configuration said straps include a pair of parallel shoulder straps including connected strap members respectively on the same side of the body of the backpack, said straps in said second configuration converging from both sides of said body of the backpack for connection by said clamp means at the center of the user's chest.

3. A backpack as claimed in claim 1 comprising signalling means of nautical type for display from the backpack.

4. A backpack as claimed in claim 3 wherein said signalling means of nautical type comprises a flag fastened to the bottom of the backpack and a lamp fastened to said cover and energized by a battery of marine type.

5. A backpack as claimed in claim 1 further comprising tapes for fastening a submarine flashlight and a spear gun to said body, closable side flaps for housing swim fins, load compressing straps including length adjustment means on said body, and rear cushions on said rear compartment for reducing pressure of the backpack against the back of the user.

6. A backpack as claimed in claim 5 comprising detachable fabric fastener means in the form of strips for connecting said cushions to said rear compartment.

7. A backpack as claimed in claim 1 wherein said means for inflating said bladder comprises an inflation valve and a quick-inflating means.

8. A backpack as claimed in claim 1 wherein said body has a front including at least one pocket positioned at said front having drainage openings.

9. A backpack as claimed in claim 8 comprising a net closing said drainage openings.

10. A backpack as claimed in claim 1 comprising a net closing said drainage openings.

11. A backpack as claimed in claim 1 wherein said body is made of a material which does not absorb water and is bright in color.

12. A backpack as claimed in claim 1 wherein said first sack is removable comprising a fabric bridge connecting said first sack to said central compartment and permitting removal of said first sack from said central compartment.

* * * * *